US005441440A

United States Patent [19]

Hundebol

[11] Patent Number: 5,441,440

[45] Date of Patent: Aug. 15, 1995

[54] METHOD AND MACHINING APPARATUS FOR USE ESPECIALLY IN THE SANDING OF ITEMS OF WOOD IN A SANDING MACHINE

[75] Inventor: Keld O. Hundebol, Ansager, Denmark

[73] Assignee: HH Patent A/S, Ansager, Denmark

[21] Appl. No.: 284,901

[22] Filed: Aug. 2, 1994

Related U.S. Application Data

[60] Continuation-in-part of Ser. No. 154,921, Nov. 18, 1993, which is a division of Ser. No. 950,416, Sep. 23, 1992, Pat. No. 5,291,689, which is a division of Ser. No. 699,181, May 13, 1991, abandoned.

[30] Foreign Application Priority Data

May 22, 1990 [WO] WIPO ..... PCT/DK90/01271

[51] Int. Cl.[6] ..... B24B 7/00

[52] U.S. Cl. ..... 451/28; 451/178; 451/184; 451/211

[58] Field of Search ..... 51/281 R, 283, 72 R, 51/215 E, 90, 76 R, 235; 451/178, 28, 41, 184, 336, 211

[56] References Cited

U.S. PATENT DOCUMENTS 1,684,029 9/1928 Howard ..... 51/283

5,274,962 3/1994 Hundebol ..... 51/72 R 5,291,689 1/1994 Hundebol ..... 51/281 R

*Primary Examiner*—Bruce M. Kisliuk

*Assistant Examiner*—Eileen P. Morgan

*Attorney, Agent, or Firm*—McAulay Fisher Nissen Goldberg & Kiel

[57] ABSTRACT

To sand the surface of an item (3) uniformly smooth, a sanding machine is used with sanding tools in the form of sanding rollers (29) which are rotated as well as turned in the same plane, and which at the same time are also moved in a different direction from the direction in which the item is conveyed, whereby during the working stroke the sanding elements on the sanding rollers (29) will sand at all possible contact angles in relation to the item (3).

To move the sanding rollers (29), the apparatus comprises a motor-driven crank arm (7), in sliding engagement with a carriage supports the sanding rollers (29), and drives the carriage on rails (33) which extend in a circle about the machine (1). This achieves a stable and robust construction which also gives the sanding rollers (29) an expedient movement characteristic, which compensates for the predominantly longitudinal sanding movements to which the items are exposed in the outer areas.

21 Claims, 5 Drawing Sheets

METHOD AND MACHINING APPARATUS FOR USE ESPECIALLY IN THE SANDING OF ITEMS OF WOOD IN A SANDING MACHINE

This application is a continuation in part of application Ser. No. 08/154,921, filed Nov. 18, 1993, pending which was a divisional of application Ser. No. 07/950,416, filed Sep. 23, 1992, now U.S. Pat. No. 5,291,689, which was a division of application Ser. No. 07/699,181 filed on May 13, 1991, now abandoned. This application is related to U.S. Pat. No. 5,274,962, based on application Ser. No. 951,041 which was a continuation of application Ser. No. 07/699,181, abandoned described above.

BACKGROUND OF THE INVENTION

This invention relates to a method of sanding, especially the sanding of items of wood, in a sanding machine, where the items are conveyed on a plane such as a vacuum plane, while at the same time the surface of the items is swept by sanding tools, said sanding tools comprising a number of sanding rollers, each secured to a spindle, and where the spindles are mounted radially outwards from a drive, and in such a manner that the individual sanding rollers rotate both around the spindle axes and around an axis of rotation which extends at right-angles to the spindle axes, and also a machining apparatus for use in the execution of the method.

Methods of this kind are known, e.g. from DK published specification no. 156,703, and are used especially in the sanding of the surfaces of items of wood, which while secured on a plane are machined by sanding rollers during their composite movement over the upper surfaces.

In order to be able to machine items with irregular surfaces such as recesses, profiles and flutes, the machining must be effected as carefully as possible out of regard for the preservation of the sharp edges, but at the same time it must be effective enough to ensure that all surfaces, including the irregular surfaces, are machined to the necessary degree.

For this purpose, the sanding rollers preferably used are made up of equally-long, flexible sanding threads or sanding bands which extend radially from a core, and which constitute the sanding roller.

Such sanding rollers are secured to individual spindles which are mounted on a drive in such a manner that the rollers project outwards from the drive like spoke from a hub.

Mounted in this way, the sanding rollers can be made to rotate on their spindles, while at the same time all of the sanding rollers simultaneously rotate around an axis which extends at right-angles to the sanding spindles.

Items placed on the feed belt are now able to be fed in under the sanding rollers, which by their composite movement will machine the items from several directions.

In correctly dimensioned machines, this method results in satisfactory sanding, but there are difficulties with items which are placed on the feed belt in such a manner that they pass closely by the axis of rotation of the sanding rollers, and in the area of the rollers' outer turning track.

In these positions, the predominant direction of sanding executed by the rollers will be the transverse and the longitudinal respectively in relation to the feeding direction of the belt. Furthermore, the ends of the sanding rollers have a relatively high speed of rotation, whereby the result of the sanding can be inferior in the outer positions.

Therefore, if the need exists for a completely perfect surface finish, the items must be sanded again or placed in another position, or use must be made of machines which are provided with several sanding heads which can be mounted in a staggered manner in relation to the feeding direction of the belt.

However, these solutions are not expedient, since they either require an extra pass through the machine, and herewith sanding time, or larger machines with several sanding systems which are both more expensive and require more maintenance.

SUMMARY OF THE INVENTION

It is an object of the invention to overcome these disadvantages and drawbacks of the known methods, and this object is achieved by a method whereby the sanding rollers are additionally moved in a reciprocating manner parallel with the plane in the direction transverse to the feeding direction of the items.

These disadvantages and drawbacks are additionally overcome by a method whereby the sanding rollers are additionally moved as a unit in a direction different from the feeding direction of the machine, and more particularly in a circular direction.

In a surprisingly simple manner, there is hereby achieved a resulting movement of the sanding rollers which provides a hitherto-unknown good degree of machining, i.e. a completely uniform and gentle sanding due to the different sanding directions from which the item is attached by the tool as well as a considerably higher sanding capacity, in that the items can have a greater extension on the conveyor belt and also be placed on the belt in a more random manner.

Together with this enhancement of the sanding effect, and herewith the machine capacity, the wear on the sanding rollers becomes more uniform, in that they are more evenly loaded, whereby the effective sanding time or endurance is considerably increased.

Finally, it must be emphasized that sanding tools, where the sanding elements rotate, are held extended by the centrifugal force, and therefore function best at a tangential sanding direction, i.e. a sanding direction which extends transversely to the sanding rollers. This requirement is fulfilled to a higher degree by the inventive method, the reason being that the resulting movement of the sanding rollers reduces to a minimum that time for which the items, relatively speaking, are moved longitudinally to the sanding rollers as compared to the known methods.

By allowing the sanding rollers to be moved past the extent of the items, in either the transverse or circular directions, the quality of the sanding becomes better due to the fact that the resulting sanding movement over the outer areas of the items becomes more uniform.

Also by moving the sanding rollers in a reciprocating or circular manner by means of an arrangement comprising a carriage which can slide on rails in the machine, the movement becomes stable and the construction relatively simple.

The moving of the carriage by means of a motor-driven crank arm results in an expedient carriage movement, since it is lower at the sides where the movement turns than at the middle, which gives the best possible pattern of movement for the sanding roller operations.

By suspending the spindle drive in a system of jointly-hinged arms, a simple and rigid construction is achieved.

Further, by being able to adjust the mutual angle of the arms, the drive can be raised and lowered and herewith the distance of the sanding rollers from the belt can be adjusted.

Also it is expedient to allow the arms to form an isosceles triangle at one wheel pair and the suspension from the drive, respectively, in that it is thereby ensured that the drive and the spindles are always situated in the same plane during raising and lowering.

BRIEF DESCRIPTION OF THE DRAWINGS

This invention will now be described in closer detail with reference to the drawings, where.

Figure 1:
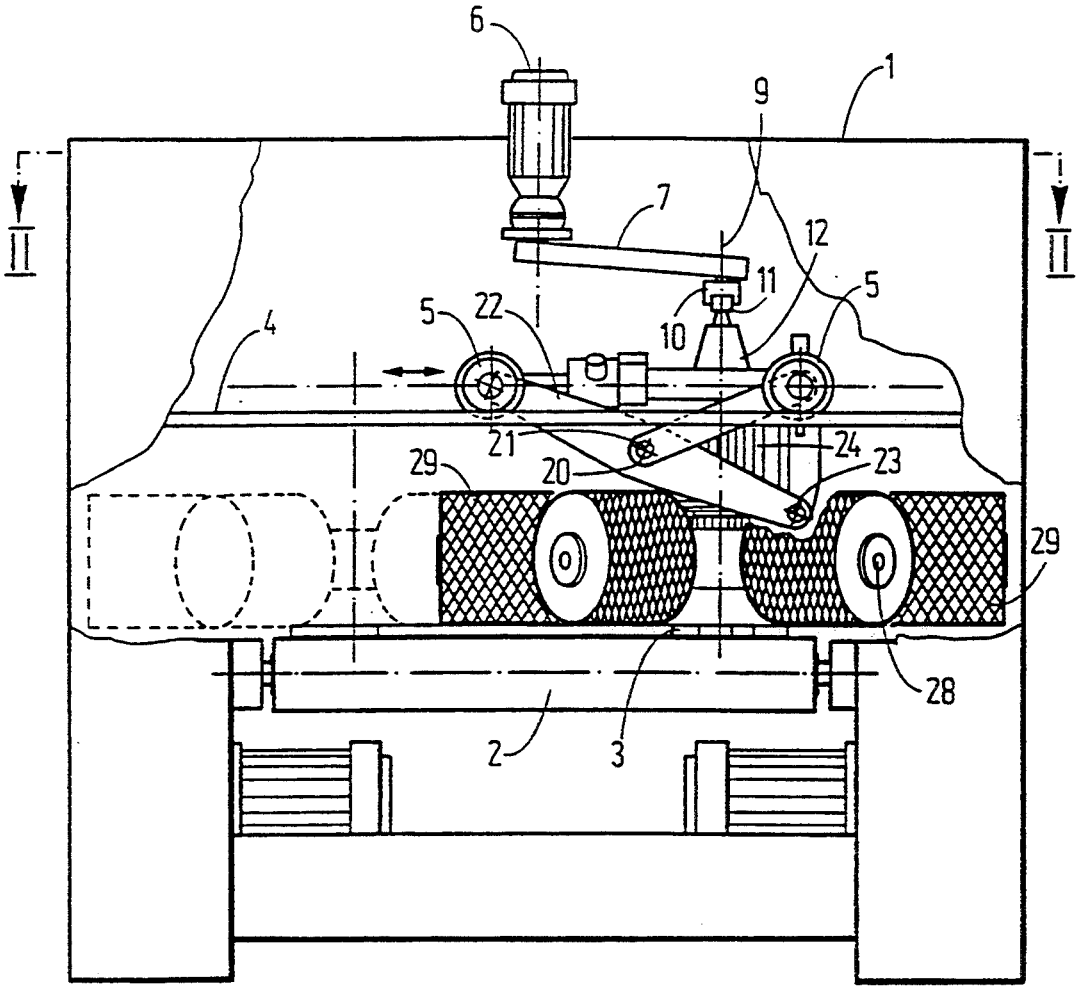
FIG. 1 shows a sanding machine for the execution of the method seen from the feed-in or the outlet end.
Figure 2:
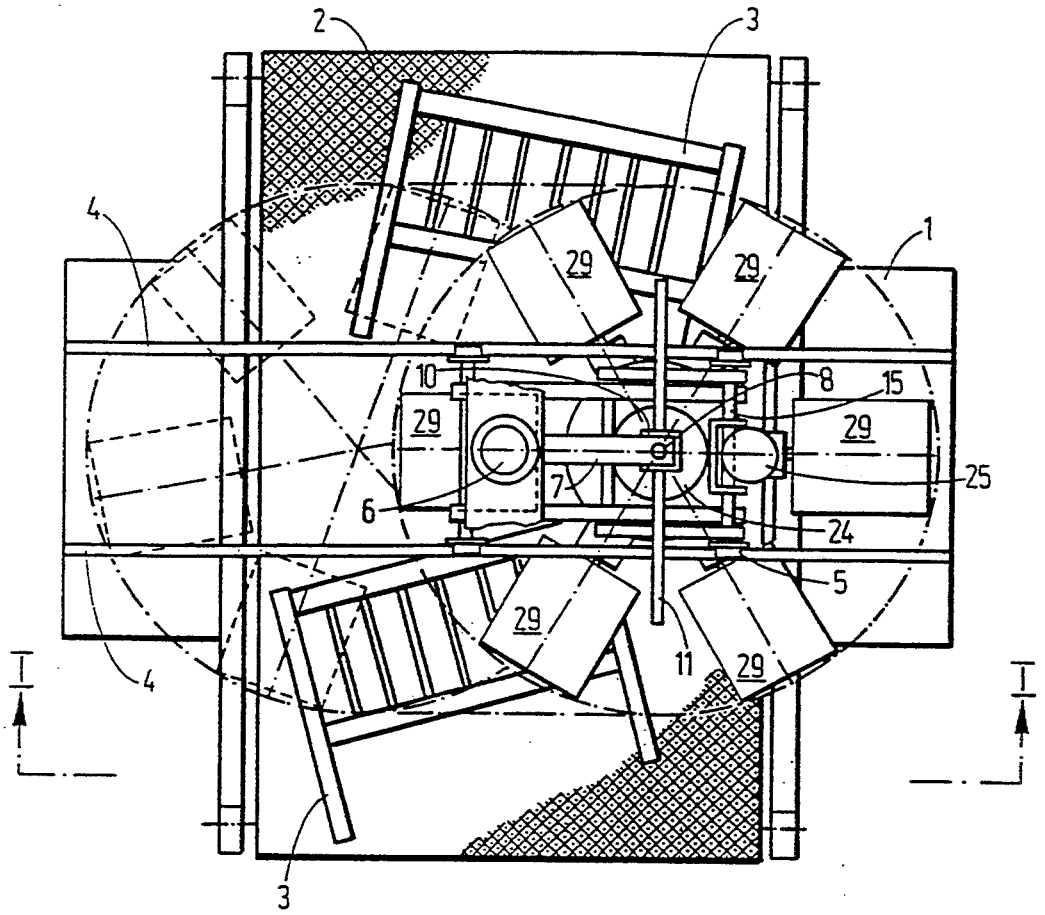
FIG. 2 shows the machine seen from the above in a section II—II in FIG. 1.
Figure 4:
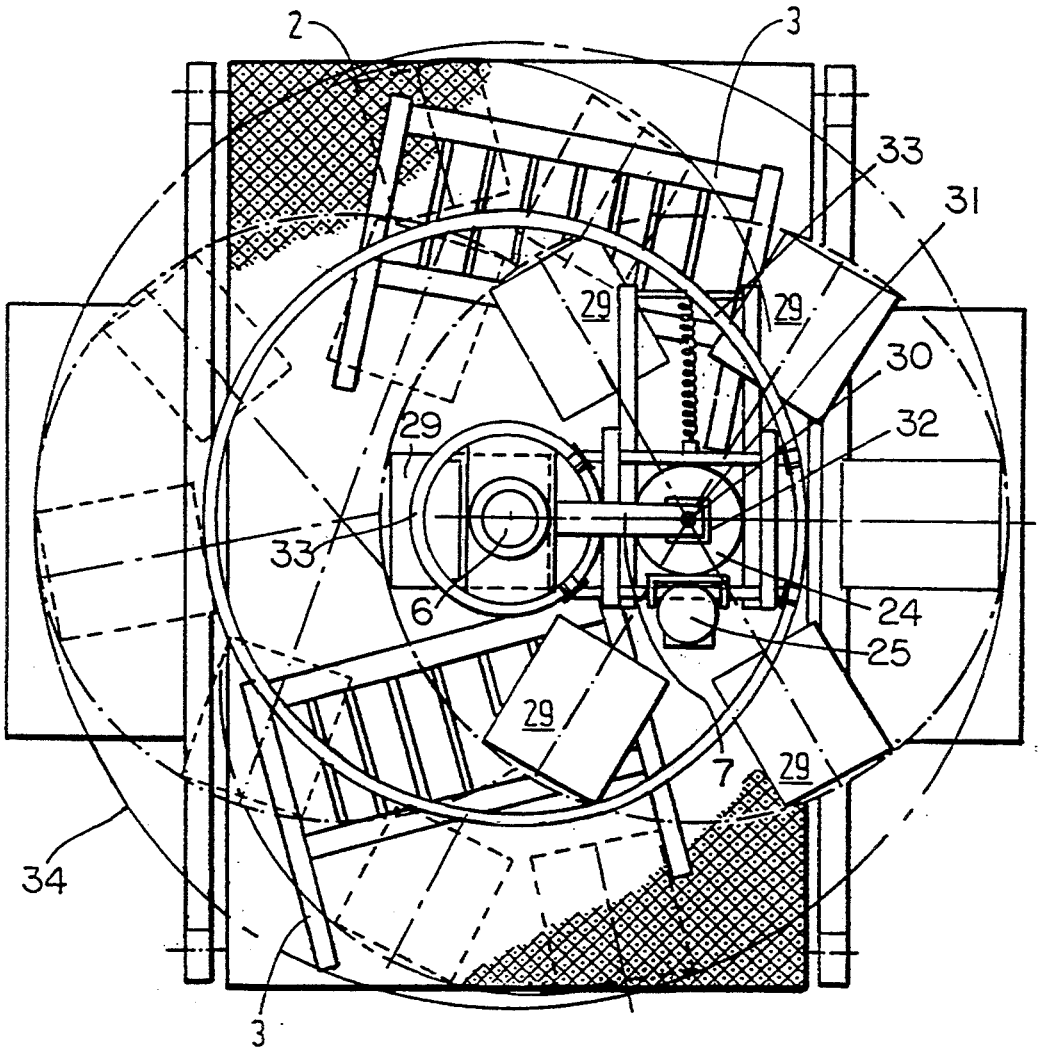
FIG. 4 shows a machine seen from above which allows the method using circular movement.
Figure 5:
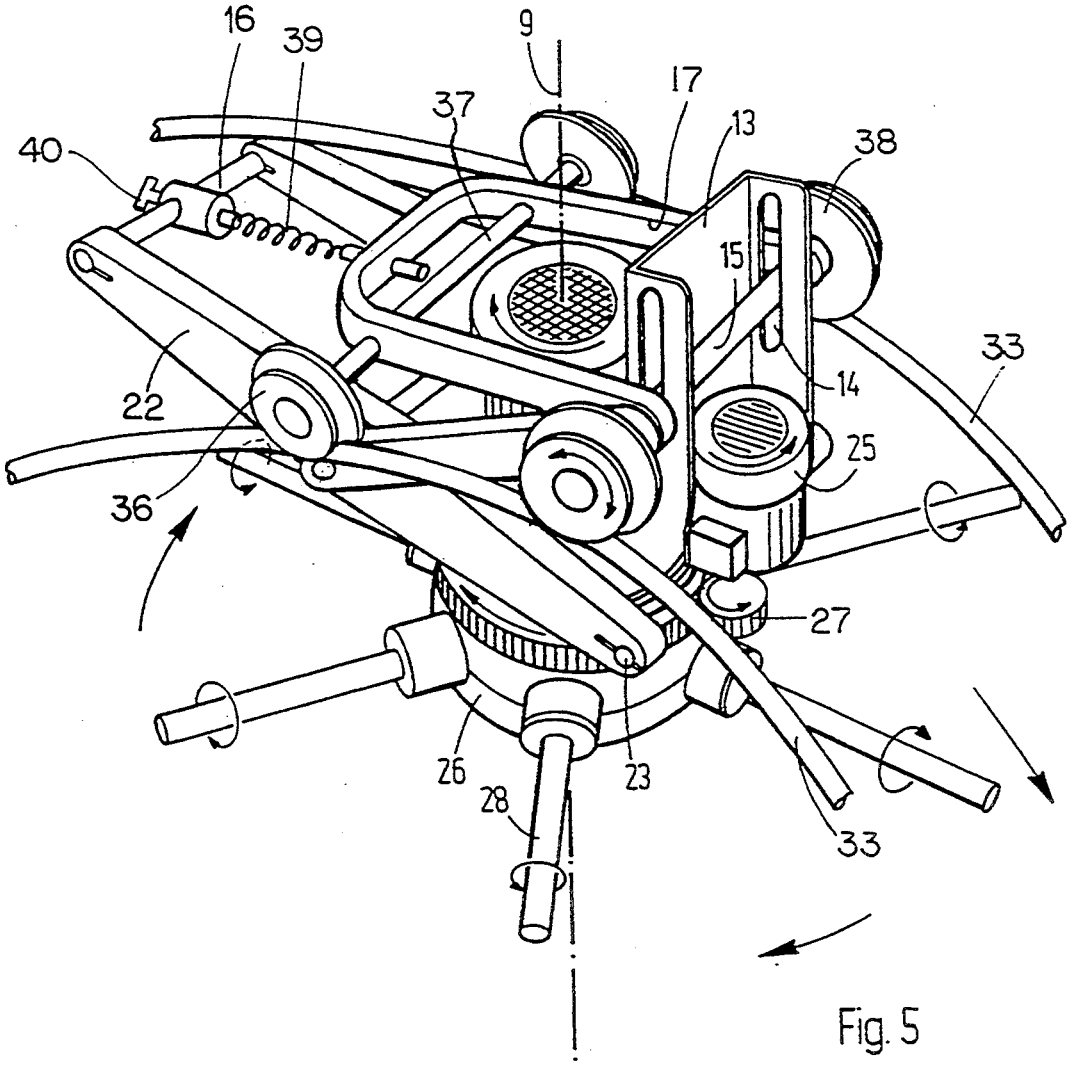
FIG. 5 shows a perspective illustration of the moving apparatus for the execution of the circular method.

An example of a machine for the execution of the transverse method is shown in FIGS. 1 and 2, and for the circular method in FIGS. 4 and 5.

DETAILED DESCRIPTION OF THE INVENTION

The machine comprises a frame which is built into a housing 1 with a through-C channel. In the bottom of said channel C there is disposed a conveyor belt 2. In the example shown, the belt is a commonly-known endless rubber belt which is provided with a number of suction holes for suction from underneath the belt, so that items 3 to be sanded, such as panels, doors, etc., placed on the belt will be secured on the belt without the need for further fastening.

As shown, the belt 2 can be moved through the machine 1, so that the items can be machined inside the machine. To effect the machining, in the machine's upper part there is mounted a machining apparatus comprising a motor 6 and an arm 7 which is secured to the motor shaft to extend substantially radially from the motor axis.

At the end of the arm 7 remote from the motor there is mounted a vertical pivot 8 (see FIG. 2) supporting an underlying slide shoe 10 or the like so that the slide shoe 10 can turn around the vertical pivot 8. The underside of shoe 10 is an inverted V shape having side legs which can grip around a slide rail 11, in that said slide rail 11 extends longitudinally with the machine as shown in FIG. 2.

Figure 3:
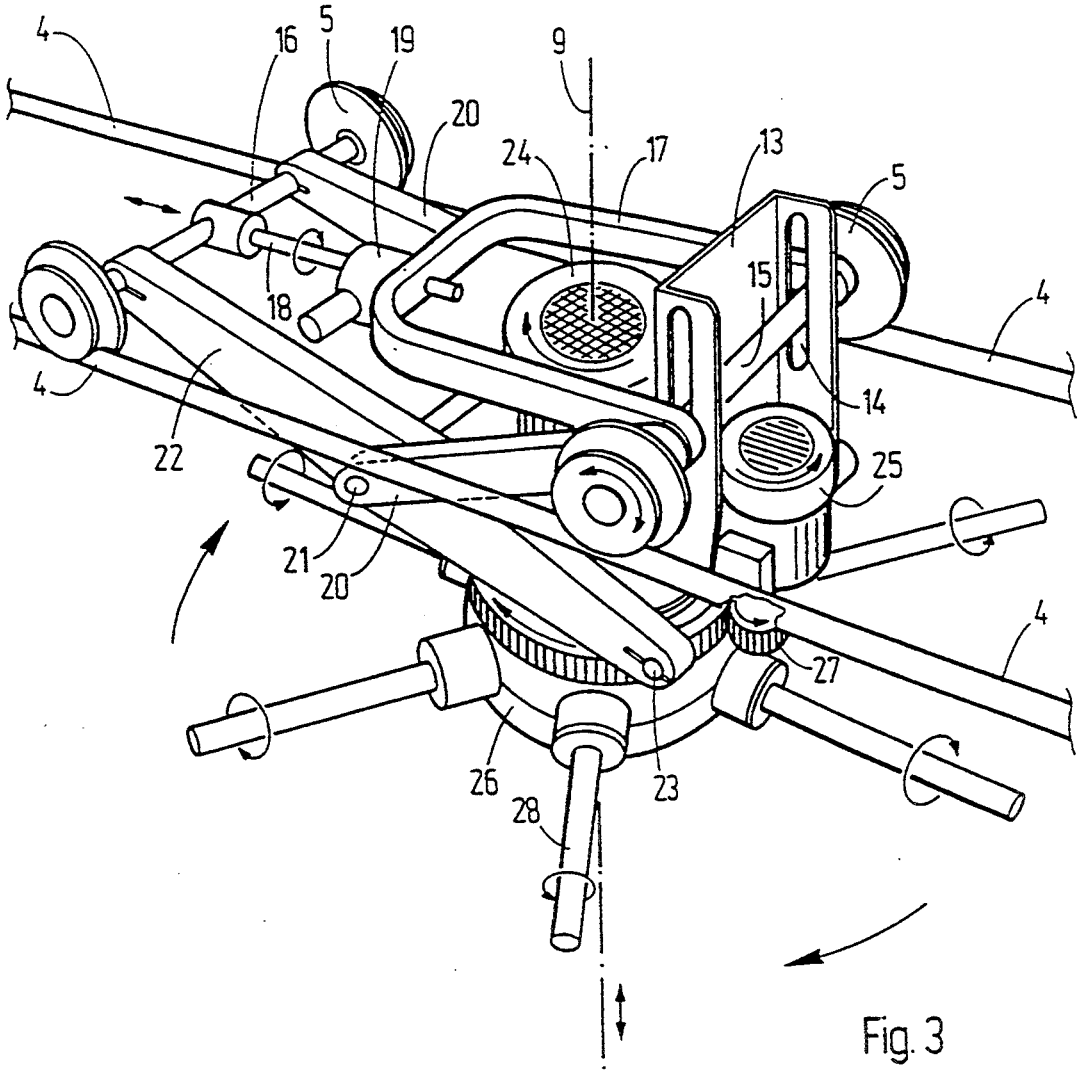
FIG. 3 shows a perspective illustration of the moving apparatus for the execution of the method.

The slide rail 11 is secured to a bracket 12, see FIG. 1, which in turn is secured to a fixed part 13 of a carriage having four wheels 5 resting on guide rails 4 on the movable sanding and moving equipment itself, which in principle is illustrated in FIG. 3. The guide rails 4 extend across and parallel to the top side of the forward moving part of belt 2 and transversely to the direction of motion of the belt.

The axis of rotation 9 of the pivot 8 is substantially coincident with the axis of rotation of the spindle drive 26. The spindle drive 26 comprises a housing from which spindles 28 project outwardly, and on which can be secured sanding elements in the form of rollers 29, as shown in FIGS. 1 and 2.

As indicated by the arrows, the spindles 28 alternately rotate the one way and the other way around, while at the same time all of the spindles are turned around by means of a drive 27 with a motor 25. A motor 24 is mounted for the rotation of the spindles via the drive. A motor 24 is carried by the carriage, and at its downwardly facing end the motor 24 is connected to a drive 26 from which a number of spindles 28 extends radially outward in a plane which is parallel to the top side of the forward moving part of the belt 2. By means of the drive 26, the spindles 28 and sanding elements 29 provided thereon can rotate in both directions, alternatively. The entire drive 26 with spindles 28 and sanding elements 29 will be rotated by means of a motor 25 and a drive 27 about an axis 9 directed at right angles to the top side of the forward moving part of the belt 2.

The whole of this spindle drive 26 is suspended in journals 23 at the end of two supporting arms 22, which at their opposite ends are pivotally connected to a wheel axle 16 with wheels 5. The motor 24 and the drive 26 are together with the motor 25 and its drive 27 supported in the journals 23 and are furthermore supported in a displaceable manner in vertical direction on the fixed part 13 in the carriage, which further support is not shown in the drawing. It will be understood that the mentioned two motors 24 and 25 and the drives 26 and 27 can only be vertically displaced, so that the shown axis 9 remains at right angles to the top side of the forward moving part of the belt 2.

At the middle of the arms 22 there are linked a pair of shorter arms 20, the opposite ends of which are provided with a wheel axle 15 with wheels 5.

These wheels 5 can rest on two guide rails 4 which extend transversely to the machine 1 and therewith to the path of movement of the belt 2, as shown in FIG. 2.

The one wheel axle 15 extends through a pair of guide slots 14 in the fixed part 13. Also linked to the wheel axle 15 are the legs of a yoke 17 which in the center is in threaded engagement with a spindle 18 which can be turned by a motor 19. The end of the spindle 18 is linked loosely to the other wheel axle 16. By rotation of a motor 19 a thread spindle 18 is rotated so that its thread engagement with a yoke 17 will cause it to be screwed into and out of the yoke 17, respectively. Since that end of the thread spindle 18 which turns away from the yoke 17 surrounds an axle 16, and the yoke 17 is connected with another axle 15, the distance between the two axles 15, 16 is shortened and increased, respectively. The arm pairs 20 and 22 hereby turn in the manner of jaw-tongs about their shared axis 21, whereby that end of the arm pair 22 which has journals 23 is vertically lowered and raised, respectively.

There is hereby formed a raising and lowering arrangement for the spindle drive, which by turning of the threaded spindle 18 results either in a lengthening of the arms 20 and 22 and thus a raising of the spindle drive 26, or a shortening for the lowering of the spindle drive 26. By this raising or lowering of the journals 23 and the displacement attachment of the motor 26 to the fixed part 13 in the carriage, the vertical direction of the axis 9 is constantly maintained, although it is parallelly displaced along the guide rails 4, whereby the spindles 28 can be turned by the drive 26 in different horizontal planes.

The distance from the mutual pivot joint 21 of the arms 20 and 22 to the wheel axle 15 is the same as the distance to the journal 23 for the drive 26, whereby it is ensured that the spindles 28 will always be in the same plane. By rotation of the motor 6, the free end of the arm 7 is moved in a circular movement which also applies to the slide shoe 10. The slide shoe 10 is pivotal about the pivot 8 relative to the arm 7, but is at the same time guided by the rail in such a manner that the slide show 10 can only be displaced in the longitudinal direction of the rail 11, i.e. parallel to the direction of motion of belt 2.

As mentioned, the moving arrangement for the carriage comprises a rotatable arm 7 which can drive the slide shoe 10 on the slide rail 11 around in a circular movement, as shown in FIG. 2. Since the motor 6 is secured to the frame, rotation of the motor 6 will move the slide shoe 10 in a circular movement relative to the rail 11 and the connected carriage which by means of the wheel pairs 5 can ride on the guide rails 4. The circular motion of the slide shoe 10 is therefore partly converted into a to and from motion along the rail 11 and to a reciprocating motion of the carriage on the guide rails 4.

The carriage with the wheels 5 will hereby roll on the guide rails 4 from the one end of the rails to the other, between the fully-drawn position to that shown with stippled lines in FIGS. 1 and 2.

As will appear from the drawing, the sanding rollers 29 are moved a distance past the extent of the items 3 along the breadth of the belt, whereby the sanding is effected within the movement pattern of the rollers 29, and preferably some distance inside.

Instead of the described machining apparatus comprising a carriage on rails which extends transversely to the feeding direction of the belt by means of an actuator, other forms of movement arrangements can be used. The spindle drive will thus be connected to a turning arrangement which gives the drive a rotating circular movement over the belt, or a reciprocating movement in an arcuate path transversely to the feeding direction of the belt.

Referring to FIG. 4, an alternative embodiment of the present invention is shown where the drive is given a rotating circular movement over the belt. The conveyor belt and the machining apparatus, as previously described in relation to FIGS. 1, 2 and 3, are shown in FIG. 4. However, at the end of the remote arm 7, there is mounted a vertical pivot 30, which is rotatably attached to a bracket 31 which in turn is secured to a fixed part 32 of the carriage which has four wheels resting on guide rails 33. Consequently, in this embodiment, the slide rail 11 is eliminated. The axis of rotation of the pivot is substantially coincidental with the axis of rotation of the spindle drive 26, as described previously. However, rather than resulting in a transverse movement as the arm 7 moves in response to the motor 6, the entire drive unit is moved in a circular direction, as illustrated by the outer boundary 34, drawn with a solid line.

The apparatus has a carriage having all four wheels resting on guide rails which extend in a circle around the moving part of the belt and overlapping it somewhat so that any item carried on the belt will be acted upon not only by the circular motions of the sanding rollers, but will also be subject to the overlapping circles of the entire head of the apparatus as it rotates about the belt.

The suspension of the spindle drive 26 is the same as described previously with journals 23 at the end of two supporting arms 22 which are connected at the opposite ends and pivotally connected to an axle 16. Arms 20 with shared axis 21 connected to axle 15 and cooperating with guide slots 14 in fixed part 13 are also used. However, wheels for supporting the carriage are not located on the axle 16. Rather wheels 36 are attached to an axle 37 which extends from the yoke 17 so as to reduce the center of the wheel extension and to increase the efficiency of the device in circular operation. In addition, the wheels 36 and wheels 38 have a jointed connection to their associated axels, so as to adapt to the curvature of the rails. However, this has no effect on the ability of the supporting arms to allow the two motors 24 and 25 and drives 26 and 27 to be vertically displaced. The other elements of the apparatus remain the same as that described in relation to FIGS. 2 and 3, except that as an alternative embodiment of the invention, the spindle 18 which can be turned by a motor 19, is replaced by a spring 39 located between the axle 16 and the yoke 17.

In the embodiment described in FIG. 3, rotation of a motor 19 rotates a threaded spindle 18 so that its thread engagement with the yoke will cause it to be screwed into and out of the yoke so as to adjust the difference between the two axels 15 and 16, which in turn results in a vertical raising and lowering of the spindle drive unit. In the alternative embodiment, the spring 39 is located between the yoke 17 and axle 16 which provides resilient biasing to balance the weight of the spindle drive against the spring force pressure. Consequently, the weight of the spindle drive can be lessened or increased by the spring pressure such that the optimal pressure for sanding is achieved, yet any excessive resistance which is encountered due to the height of a particular article passing through the machine will overcome the spring bias and allow the spindle drive to move upwardly to prevent an overpressure condition and oversanding of the article as it passes through the machine. Consequently, the height of the spindle drive is adjusted automatically while the machine is in operation.

It is contemplated that the amount of spring biasing could be altered automatically during machine operation, using a motor similar to that described in relation to threaded shaft 18, which can result in a tightening or loosening of the spring pressure without an operator having to gain access to the interior of the machine. Of course, manual adjustment is also possible using a screw 40 as shown in FIG. 5 which can be adjusted between sanding operations.

The following is a description of the reciprocating method.

The sanding rollers 29 are made to rotate by means of the motor 24, and are turned around the axis of rotation 9 by means of the motor 25.

The moving arrangement for the carriage can now be activated by starting the motor 6 on the machine 1, whereby the carriage will move in a reciprocating manner on the guide rails 4.

Items 3 can now be placed on the belt 2, which can be moved to traverse through the machine by means of a suitable driving arrangement (not shown).

The sanding rollers 29 can now be lowered by means of the motor 19 until a suitable contact is established between the sanding elements on the rollers and the items.

The sanding movement, which is described by the individual sanding elements on the rollers 29, comprises both a rotation around the spindle axle and a turning movement around the center axis 9 of the drive, whereby the area shown in fully-drawn lines in FIGS. 1 and 2 is swept, and also a reciprocating transverse movement for sweeping between the fully-drawn area and the area shown with stippled lines.

The following is a description of the circular movement method.

The sanding rollers 29 are made to rotate by means of the motor 24, and are turned around the axis of rotation 9 by means of the motor 25.

The moving arrangement for the carriage can now be activated by starting the motor 6 on the machine 1, whereby the carriage will move in a circular manner on the guide rails 33.

Items 3 can now be placed on the belt, which can be made to traverse through the machine by means of a suitable driving arrangement (not shown).

The sanding rollers 29, being suspended by the spring 39 are maintained in a balanced position offset by the weight of the drive, and respond by vertically raising or lowering of the drive in response to resistance pressure established by the height of the objects which are passing between the sanding elements of the rollers. The drive, however, maintains its planar orientation during this raising or lowering movement.

The sanding movement, which is described by the individual sanding elements on the rollers 29, comprise both a rotation about the spindle axes and a turning movement around the center axes of the drive, whereby the area shown in fully drawn lines in FIG. 4 are swept, and also circular movement for sweeping the entire circular area which covers the belt is achieved.

The result achieved hereby is the especially effective sanding mentioned above, in that the sanding is effected by a relatively constant speed of contact between the item and the individual sanding elements, which is due to the expedient equalization of the speed components during the movement reversals of the carriage, or by the circular over lap pattern. In addition to the advantage of the more uniform sanding in the full extent of the belt 2, which reduces sanding damage and increases the efficiency, a considerably more uniform wear is achieved on the sanding rollers 29, which therefore require less frequent replacement, which results in low operational expenses.

I claim:

1. Sanding apparatus comprising: spindle drive means, means for rotating said spindle drive means;

a plurality of spindles each extending radially from said spindle drive means, a sanding roller on each said spindle, the spindle drive means being suspended at one end of two first arms, each of the first arms at their opposite ends connected together by a first shaft, two second arms, a second axle mounted to one end of the two second arms, the second axle supporting a first wheel pair, a yoke at one end thereof supporting a second wheel pair, said yoke at an opposite end connected to second axle the second arms at their opposite ends being linked to the first arms;

means for rotating each of said spindles with the sanding roller thereon;

means for conveying the articles to be sanded beneath the sanding rollers along a path in a first direction; and means for moving the spindle drive means and the rotating spindles thereon in a circular direction about said path.

2. Sanding apparatus according to claim 1 further comprising carriage means for traveling a path in said circular direction, said carriage means carrying said spindle drive means, actuator means for moving the carriage means comprising a motor, an arm over the center of the carriage's path of movement, said arm connected at one end of the motor, a rotating coupling secured on the carriage, a second end of the arm being in pivoting engagement with the coupling, wherein rotation of the arm by the motor around an axis which is parallel with the axis of rotation of the spindle drive means, effects a circular movement of the carriage.

3. Sanding apparatus according to claim 1 wherein an angle between the two sets of arms can be varied for the raising and lowering of the spindle drive means.

4. Sanding apparatus according to claim 1 wherein a distance between the linkage of the second arms to the first arms and the spindle drive means on the first arms corresponds to a distance between the linkage and the second axle on the second arms.

5. The apparatus of claim 1 further comprising means to vertically displace the spindle drive means during sanding.

6. The apparatus of claim 5 wherein the means to vertically displace the spindle drive means during sanding comprises a threaded rod having a first end threadably engaged to the first axle and a second end rotatably engaged to the yoke.

7. The sanding apparatus of claim 6 further comprising a motor for rotating the threaded rod.

8. The sanding apparatus of claim 5 wherein the means for vertically displacing the spindle drive means comprise a spring located between the yoke and the first axle.

9. The sanding apparatus of claim 8 further comprising a motor to adjust a tension of the spring.

10. Sanding apparatus comprising:

spindle drive means, means for rotating said spindle drive means;

a plurality of spindles each extending radially from said spindle drive means, a sanding roller on each said spindle;

means for rotating each of said spindles with the sanding roller thereon;

means for conveying the articles to be sanded beneath the sanding rollers along a path in a first direction; and means for moving the spindle drive means and the rotating spindles thereon in a circular direction about said path, the spindle drive means being suspended at one end of two first arm means, a the spindle drive means housing yoke which supports first wheel means, at one end thereof, said yoke at an opposite end connected to second wheel means said second wheel means mounted to one end of second arm means, the second arm means supporting the first arm means, second arm means at their opposite ends being linked to the first arm means.

11. The sanding apparatus according to claim 10 wherein a distance between the linkage of the second arm means to the first arm means and the spindle drive means on the first arm means corresponds to the distance between the linkage and the second wheel means on the second arm means.

12. A method of sanding comprising:

providing a plurality of sanding rollers each located on a respective spindle having a longitudinal axis extending radially outward from a spindle drive, the spindle drive being suspended at one end of two first arms, each of the first arms at their opposite ends connected together by a first shaft, two second arms, a second axle mounted to one end of the two second arms, the second axle supporting a first wheel pair, a yoke at one end thereof supporting a second wheel said yoke at an opposite end connected to second axle pair, the second arms at their opposite ends being linked to the first arms;

rotating said spindle drive with said spindles thereon;

rotating said spindle drive with said spindle drive thereon;

driving each of said spindles independently of said spindle drive and rotating the sanding roller thereon as the spindle drive is rotated;

conveying articles to be sanded along a path in a first direction beneath said driven sanding rollers to be contacted thereby; and moving said rotating spindle drive carrying the driven spindles with the rotating sanding rollers thereon in a circular direction over said path as the articles are moving in the first direction therebeneath;

uniformly and gently sanding the articles by contacting the articles with the driven sanding rollers which attack the articles from many different sanding directions as the articles pass beneath the moving rotating spindle drive carrying the rotating spindles.

13. The method of claim 12 further comprising moving said rotating spindle drive carrying the driven spindles with the rotating sanding rollers thereon in an upward or downward direction while maintaining the spindles in the same plane.

14. Sanding apparatus comprising:

spindle drive means, means for rotating said spindle drive means;

a plurality of spindles each extending radially from said spindle drive means, a sanding roller on each said spindle;

means for rotating each of said spindles with the sanding roller thereon;

means for conveying the articles to be sanded beneath the sanding rollers along a path in a first direction; and means for moving the spindle drive means and the rotating spindles thereon in a circular direction about said path; and carriage means for traveling a path in said circular direction, said carriage means carrying said spindle drive means, actuator means for moving the carriage means comprising a motor, an arm over the center of the carriage's path of movement, said arm connected at one end of the motor, a rotating coupling secured on the carriage, a second end of the arm being in pivoting engagement with the coupling, wherein rotation of the arm by the motor around an axis which is parallel with the axis of rotation of the spindle drive means, effects a circular movement of the carriage.

15. The apparatus of claim 14 further comprising means to vertically displace the spindle drive means during sanding.

16. The apparatus of claim 15 wherein the spindle drive means is suspended at one end of first arm means, which are connected at an opposite end thereof to first shaft means, second arm means, second axle means mounted to one end of the second arm means, the second axle means supporting first wheel means, said yoke at an opposite end connected to second axle a yoke at one end thereof supporting second wheel means, an opposite end of the second arm means being linked to the first arm means, and wherein the means to vertically displace the spindle drive means during sanding comprises a threaded rod having a first end threadably engaged to the first axle means and a second end rotably engaged to the yoke.

17. The sanding apparatus of claim 16 further comprising a motor for rotating the threaded rod.

18. The sanding apparatus of claim 15 wherein the means for vertically displacing the spindle drive means comprise a spring located between the yoke and the first axle means.

19. The sanding apparatus of claim 18 further comprising a motor to adjust a tension of the spring.

20. A method of sanding comprising:

providing a plurality of sanding rollers each located on a respective spindle having a longitudinal axis extending radially outward from a spindle drive;

radially outward from a spindle drive;

rotating said spindle drive with said spindle drive thereon;

drive and rotating the sanding roller thereon as the spindle drive is rotated;

conveying articles to be sanded along a path in a first direction beneath said driven sanding rollers to be contacted thereby;

providing carriage means for traveling a path in said circular direction, said carriage means carrying said spindle drive, actuator means for moving the carriage means comprising a motor, an arm over a center of the carriage's path of movement, said arm connected at one end of the motor, a rotating coupling secured on the carriage, a second end of the arm being in pivoting engagement with the coupling, wherein rotation of the arm by the motor around an axis which is parallel with the axis of rotation of the spindle drive means, effects a circular movement of the carriage;

moving said rotating spindle drive carrying the driven spindles with the rotating sanding rollers thereon in a circular direction over said path as the articles are moving in the first direction therebeneath; and uniformly and gently sanding the articles by contacting the articles with the driven sanding rollers which attack the articles from many different sanding directions as the articles pass beneath the moving rotating spindle drive carrying the rotating spindles.

21. The method of claim 20 further comprising moving said rotating spindle drive carrying the drive spindles with the rotating sanding rollers thereon in an upward or downward direction while maintaining the spindles in the same plane.

* * * * *